United States Patent [19]

Hiyama et al.

[11] Patent Number: 4,674,461

[45] Date of Patent: Jun. 23, 1987

[54] UNIT INJECTOR FOR INTERNAL COMBUSTION ENGINES

[75] Inventors: Yasuhiro Hiyama; Shinya Nozaki, both of Higashimatsuyama, Japan

[73] Assignee: Diesel Kiki Co., Ltd., Tokyo, Japan

[21] Appl. No.: 780,393

[22] Filed: Sep. 26, 1985

[30] Foreign Application Priority Data

Oct. 2, 1984 [JP] Japan ..... 59-205573
Oct. 2, 1984 [JP] Japan ..... 59-205574

[51] Int. Cl.[4] ..... F02M 39/00

[52] U.S. Cl. ..... 123/500; 123/179 L; 123/198 D; 239/95

[58] Field of Search ..... 123/506, 179 L, 500, 123/501, 458, 198 D, 198 DB; 239/88–95

[56] References Cited

U.S. PATENT DOCUMENTS

| | | | |
|---|---|---|---|
| 3,698,373 | 10/1972 | Nagasawa | 123/179 L |
| 4,165,723 | 8/1979 | Straubel | 123/500 |
| 4,327,694 | 5/1982 | Henson | 123/179 L |
| 4,411,238 | 10/1983 | Ecomard | 123/500 |
| 4,412,519 | 11/1983 | Hoch | 123/500 |
| 4,448,169 | 5/1984 | Badgley | 123/501 |
| 4,489,684 | 12/1984 | Yamada | 123/198 F |

FOREIGN PATENT DOCUMENTS

| | | | |
|---|---|---|---|
| 54-50726 | 4/1979 | Japan | 123/500 |

*Primary Examiner*—Carl Stuart Miller
*Attorney, Agent, or Firm*—Frishauf, Holtz, Goodman & Woodward

[57] ABSTRACT

A unit injector for an internal combustion engine has a solenoid valve for closing a fuel overflow passage to determine the injection timing and the injection quantity. A pumping plunger has its outer peripheral surface formed with first and second longitudinal slits both communicating with the plunger chamber, and a circumferentially extending suction slit communicating with the first longitudinal slit and registrable with a fuel intake passage when the plunger is in an extreme position remote from the plunger chamber. The plunger can assume selectively a normal operating position, a starting position, and an emergency stopping position, at respective different circumferential positions thereof. In the normal operating position, the plunger chamber communicates with the fuel intake passage through alignment of the first longitudinal slit or the suction slit with the fuel intake passage, and also communicated and with the fuel overflow passage via the second longitudinal slit. In this position, the fuel injection rate may be reduced by a leakage groove continuous with the first longitudinal slit. In the starting position the plunger chamber communicates with the fuel intake passage through alignment of the first longitudinal slit or the suction slit with the fuel intake passage, but is disconnected from the the fuel overflow passage. In the emergency stopping position, the plunger chamber is dsconnected from both the fuel intake passage and the fuel overflow passage, or the plunger chamber is communicated with the fuel intake passage through the first longitudinal slit during the pressure delivery stroke of the plunger.

9 Claims, 14 Drawing Figures

NORMAL OPERATING POSITION

STARTING POSITION

EMERGENCY STOPPING POSITION

SUCTION STROKE
PRESSURE DELIVERY STROKE

1st NORMAL OPERATING POSITION
FIG.5 (A1)

2nd NORMAL OPERATING POSITION
FIG.5 (B1)

STARTING POSITION
FIG.5 (C1)

EMERGENCY STOPPING POSITION
FIG.5 (D1)
13
14
16
18
27
28
29
32

UNIT INJECTOR FOR INTERNAL COMBUSTION ENGINES

BACKGROUND OF THE INVENTION

This invention relates to unit injectors for internal combustion engines, which have an injection nozzle and a pumping plunger combined in one body.

A unit injector of this kind is already known, e.g. from Japanese Provisional Patent Publication No. 54-50726, which is adapted to have the injection initiated and the injection ended both under control of a single solenoid valve. However, this prior art unit injector is unable to have its injection rate controlled by the solenoid valve. Further, at the start of the engine, the operation of the solenoid valve can become uncertain due to a low supply voltage of the battery for driving the valve, caused by operation of the self-starting motor driven by the battery. Consequently, the solenoid valve fails to obtain an increased fuel injection quantity at the start of the engine, resulting in low startability of the engine. Moreover, the conventional unit injector also has another disadvantage that it is unable to immediately stop the fuel injection in the event of a failure in the solenoid valve, the control system for the valve, etc.

SUMMARY OF THE INVENTION

It is an object of the invention to provide a unit injector for an internal combustion engine, which is of the type having the injection timing and the injection quantity both controlled by its solenoid valve and which is capable of obtaining without fail an increased fuel injection quantity at the start of the engine.

It is a further object of the invention to provide a unit injector of this kind, which has the injection rate controllable according to operating conditions of the engine.

It is another object of the invention to provide a unit injector of this kind, which is capable of immediately stopping the fuel injection upon occurrence of a failure in the solenoid valve, the control system, etc.

It is still another object of the invention to provide a unit injector of this kind, which can be manufactured with minimum alterations to a conventional unit injector of this kind, thereby lowering the manufacturing cost.

The present invention provides a unit injector for an internal combustion engine, including an injection nozzle, a plunger barrel combined in one body with said injection nozzle, a pumping plunger slidably received within said plunger barrel for reciprocating motion therein and controllable in circumferential position, a fuel intake passage opening into the plunger barrel and blockable by the outer peripheral surface of the plunger, a fuel overflow passage opening into the plunger barrel and blockable by the outer peripheral surface of the plunger, a plunger chamber definable within the plunger barrel and by an end face of the plunger, communication passage means formed in the outer peripheral surface of the plunger for communicating the plunger chamber with a fuel intake passage and a fuel overflow passage, and a solenoid valve arranged across the fuel overflow passage for closing same to determine the injection timing and the injection quantity.

The unit injector according to the invention is characterized as follows: The communication means comprises first and second longitudinal slits both communicating with the plunger chamber, and a circumferentially extending suction slit communicating with the first longitudinal slit and registrable with the fuel intake passage when the plunger is in an extreme position remote from the plunger chamber. The fuel intake passage, the fuel overflow passage, the first and second longitudinal slits, and the suction slit are so disposed that the plunger can assume selectively a normal operating position and a starting position, at respective first and second circumferential positions thereof. In the normal operating position of the plunger, one of the first longitudinal slit and the suction slit is circumferentially aligned with the fuel intake passage to communicate same with the plunger chamber, and the second longitudinal slit is circumferentially aligned with the fuel overflow passage to communicate same with the plunger chamber. In the starting position of the plunger, one of the first longitudinal slit and the suction slit is circumferentially aligned with the plunger chamber, but the second longitudinal slit is circumferentially out of alignment with the fuel overflow passage to maintain the fuel overflow passage disconnected from the plunger chamber.

Further, the plunger may assume an emergency stopping position at a third circumferential position thereof, wherein both of the first longitudinal slit and the suction slit are circumferentially out of alignment with the fuel intake passage, and the second longitudinal slit is circumferentially out of alignment with the fuel overflow passage to be disconnected from the plunger chamber.

Alternatively, the emergency stopping position may be a position wherein the first longitudinal slit is circumferentially aligned with the fuel intake passage, and the first longitudinal slit extends along an axial portion of the plunger beyond the suction slit toward an opposite end of the plunger remote from the plunger chamber, whereby the first longitudinal slit continually communicates the plunger chamber with the fuel intake passage while the plunger is moving through a pressure delivery stroke thereof.

The outer peripheral surface of said plunger may be further formed with a leakage groove axially extending from the suction slit toward an opposite end of the plunger remote from the plunger chamber and continuous with a side edge of the first longitudinal slit, and the normal operating position of the plunger comprises a first normal operating position in which the leakage groove is circumferentially out of alignment with the fuel intake passage to be continually blocked by the outer peripheral surface of the plunger while the plunger is moving through a pressure delivery stroke thereof, and a second normal operating position in which the leakage groove is circumferentially aligned with the fuel intake passage to be continually communicated therewith while the plunger is moving through the pressure delivery stroke to allow leakage of fuel from the plunger chamber to the fuel intake passage through the first longitudinal slit and the leakage groove to thereby reduce the injection rate.

The above and other objects, features and advantages of the invention will be more apparent from the ensuing detailed description taken in conjunction with the accompanying drawings.

DETAILED DESCRIPTION OF THE PREFERRED EMBODIMENTS

The invention will now be described in detail with reference to the drawings showing embodiments thereof.

Figure 1:
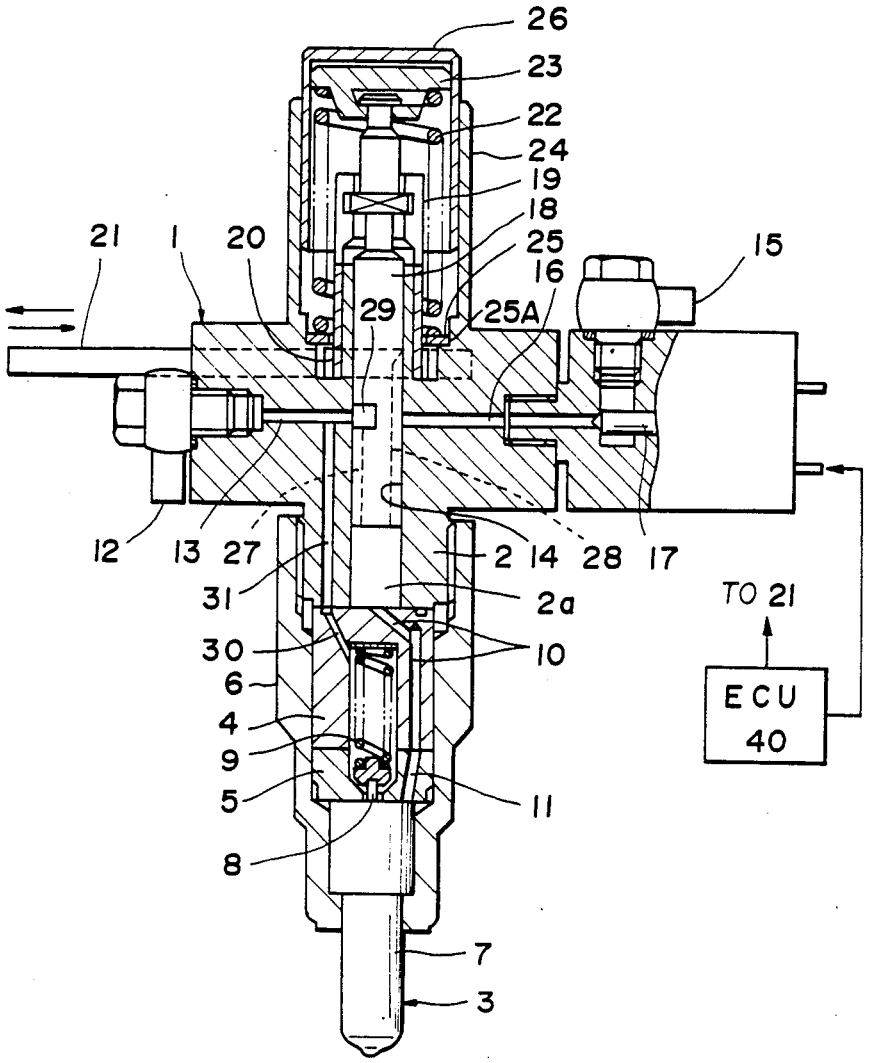
FIG. 1 is a longitudinal sectional view of a unit injector according to a first embodiment of the invention.

Referring first to FIG. 1, there is shown a unit injector according to an embodiment of the invention. Reference numeral 1 designates a main body of the unit injector, which is formed integrally with a plunger barrel 2. An injection nozzle 3 is supported by the plunger barrel 2 by means of a retaining nut 6 which is threadedly fitted on the plunger barrel 2 and covers distance pieces 4 and 5 interposed between the plunger barrel 2 and the injection nozzle 3. The injection nozzle 3 comprises a nozzle body 7, a nozzle needle 8 axially and slidably fitted in the nozzle body 7 for closing and opening injection holes, not shown, formed in the nozzle body 7, and a nozzle spring 9 arranged in the distance pieces 4, 5 and urging the nozzle needle 8 in a downward direction for closing the injection holes. Defined within the plunger barrel 2 is a plunger chamber 2*a* which communicates with a pressure chamber, not shown, defined within the nozzle body 7 in the vicinity of the injection holes, by way of passages 10 and 11, as well as a passage, not shown, formed in the nozzle body 7.

A fuel intake connector 12 is mounted on one side of the main body 1 of the unit injector, of which an intake port, not shown, communicates with a plunger bore 14 axially formed within the plunger barrel 2 and defining in part the plunger chamber 2*a*, by way of a fuel intake passage 13 formed within the main body 1. Another connector 15 is arranged at the opposite side of the main body 1, a port of which can communicate with the plunger bore 14 by way of a fuel overflow passage 16 formed in the main body 1. The fuel overflow passage 16 and the fuel intake passage 13 have their mutually facing ends opening into the plunger bore 14 and extend on a straight line, that is, are circumferentially located apart from each other through 180 degrees.

A solenoid valve 17 is arranged across the fuel overflow passage 16, which controls the fuel injection timing and the fuel injection quantity under the control of an electronic control device 40, hereinafter referred to.

Figure 2A:
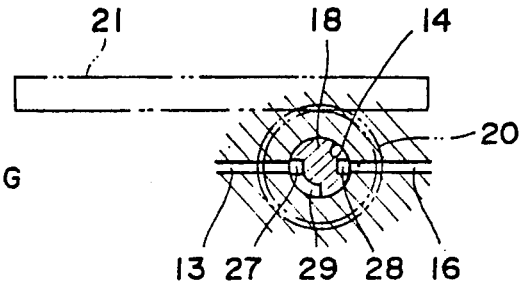
FIGS. 2(A)-(C) are transverse cross-sectional views of an essential part of the unit injector of FIG. 1, useful in explaining its operation.
Figure 2B:
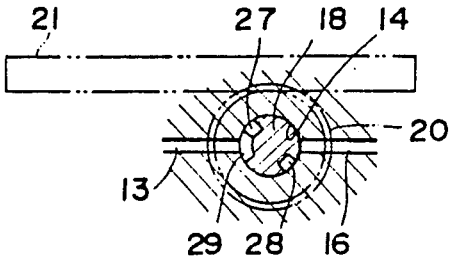
Figure 2C:
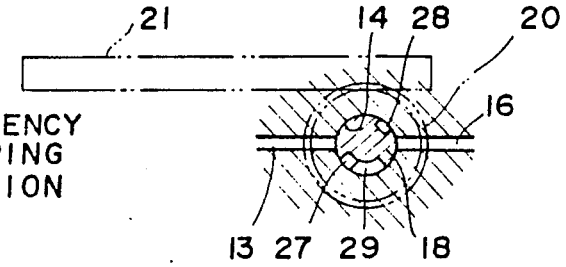

A pumping plunger 18 is slidably fitted into the plunger bore 14 for rotation and reciprocating motion therein. The pumping plunger 18 is controlled to selectively assume three positions, i.e. a normal operating position, a starting position, and an emergency stopping position, as shown in FIGS. 2 (A), (B), and (C), respectively, as will be explained hereinafter. A control sleeve 19 is rotatably arranged on top of the plunger 18 in a manner prohibiting rotation of the plunger relative to the control sleeve but allowing axial movement of the former relative to the latter. A pinion 20 is secured on the control sleeve 19 and meshes with a control rack 21 for controlling the rotation of the pumping plunger 18 in such a manner that as the control rack 21 is moved in directions indicated by arrows in FIG. 1, the pumping plunger 18 is rotated about its own axis. The control rack 21 is driven by a suitable driving means, not shown, such as a hydraulic piston and a steppeing motor.

The pumping plunger 18 is upwardly urged by a plunger spring 22 interposed between a spring seat 23 secured on top of the pumping plunger 18, and a stepped shoulder 25 formed in a bottom portion of a hollow tubular protuberance 24 upwardly projected integrally from a ceiling surface of the main body 1. The spring seat 23 is fitted within a U-shaped cylindrical cover 26 which is axially and slidably fitted in the hollow tubular protuberance 24.

A rotating cam, not shown, has its camming surface disposed in urging contact with an upper end face of the cover 26, and is rotatively driven by an internal combustion engine, not shown, to cause reciprocating movement of the pumping plunger 18 as it rotates.

The plunger chamber 2*a* is defined within the plunger bore 14 between a lower end face of the pumping plunger 18 and an upper end face of the distance piece 4.

The pumping plunger 18 has its outer peripheral surface formed with a first longitudinal slit 27 at one side, and a second longitudinal slit 28 at the opposite side. These first and second longitudinal slits 27, 28 extend axially of the plunger 18 and are circumferentially located apart from each other through 180 degrees. Lower ends of the first and second longitudinal slits 27, 28 open in a lower end face of the plunger 18, while upper ends of them are located at axially intermediate portions of the plunger 18. The upper end of the first slit 27 is lower in level than the upper end of the second slit 28 by a predetermined distance, and is so located as to be on almost the same level with the transversely extending fuel intake passage 13 when the plunger 18 is in its upper extreme position as illustrated in FIG. 1. The upper end of the second longitudinal slit 28 is so located as to maintain its communication with the fuel overflow passage 16 throughout the whole lifting stroke of the plunger 18. The first and second longitudinal slits are so circumferentially arranged that the fuel intake passage 13 is circumferentially aligned with the first longitudinal slit 27, and the fuel overflow passage 16 with the second longitudinal slit 28, respectively, when the plunger 18 assumes the normal operating position as shown in FIG. 2 (A).

The pumping plunger 18 has its outer peripheral surface further formed with a circumferentially-extending suction slit 29 at an axially intermediate location, which is continuous at one end with the first longitudinal slit 27. The suction slit 29 is so located as to be circumferentially aligned or communicated with the fuel intake passage 13 when the plunger 18 assumes the starting position as shown in FIG. 2 (B), whereby the fuel intake passage 13 is communicated with the first longitudinal slit 27 via the suction slit 29.

The solenoid valve 17 and the control rack 21 are electrically connected to the electronic control device 40 to be controlled thereby. The control device 40 is supplied with signals indicative of various engine operating parameters such as engine rotational speed, engine load, engine coolant temperature, and exhaust gas temperature, from respective engine operation parameter sensors, not shown. Control device 40 calculates, on the basis of these input signals, values of the fuel injection timing, the fuel injection quantity, etc. which are optimal to operating conditions of the engine. It supplies the resulting control signals to the solenoid valve 17 and an actuator, not shown, for the control rack 21. The fuel intake connector 12 is connected to a feed pump via a pipe, neither of which is shown, while the fuel outlet connector 15 is connected to a fuel tank via a pipe, neither of which is shown. In FIG. 1, reference numerals 30 and 31 designate, respectively, return passages formed in the distance piece 4 and the main body 1 of the unit injector for returning fuel leaking from the injection nozzle 3 into the fuel intake passage 13.

The unit injector constructed as above operates as follows:

When the engine is in a normal operative state, the electronic control device 40 drives the control rack 21 to bring the pumping plunger 18 into the normal operating position shown in FIG. 2 (A). With the plunger 18 in this position, the fuel intake passage 13 is communicated with the plunger chamber 2*a* via the first longitudinal slit 27, and the fuel overflow passage 16 with the chamber 2*a* via the second longitudinal slit 28, respectively, when the plunger 18 is located in its upper extreme position as illustrated in FIG. 1.

As the rotating cam is rotated by the engine to cause reciprocating motion of the spring seat 23 acting as a tappet, through the cover 26, the pumping plunger 18 is forced to make reciprocating motion within the plunger bore 14, with the aid of the plunger spring 22. During the lifting or suction stroke of the plunger 18, fuel is drawn through the fuel intake connector 12, the fuel intake passage 13 and the first longitudinal slit 27 into the plunger chamber 2*a*. Then, as the the plunger 18 moving through its descending or pressure delivery stroke, the fuel intake passage 13 is blocked by the outer peripheral surface of the plunger 18. When the fuel overflow passage 16 is then closed by the solenoid valve 17, the fuel drawn into the plunger chamber 2*a* starts to be pressurized into a higher pressure and then delivered into the pressure chamber within the nozzle body 7 through the passages 10, 11. When the fuel pressure within the pressure chamber rises to overcome the force of the nozzle spring 9 (that is, when it reaches the valve opening pressure), the nozzle needle 8 is lifted to open the injection nozzles to inject fuel into the engine cylinder.

The fuel injection timing is determined by the timing of closing the solenoid valve 17, and the fuel injection quantity by the duration of closure of the solenoid valve 17. These closing timing and closing duration for the solenoid valve 17 are represented by the control signals from the electronic control device 40 as optimal to an operating condition in which the engine is operating, as hereinbefore stated.

On the other hand, to start the engine, the electronic control device 40 drives the control rack 21 to bring the plunger 18 into the starting position shown in FIG. 2 (B), which is reached by rotating the plunger 18 clockwise by nearly 45 degrees from the normal operating position, in the illustrated embodiment. In this starting position, the suction slit 29 is circumferentially aligned with the fuel intake passage 13, and the second longitudinal slit 28 is circumferentially out of alignment with the fuel overflow passage 16, so that when the plunger 18 is in its upper extreme position, the fuel intake passage 13 is communicated with the plunger chamber 2*a* via the the suction slit 29 and the first longitudinal slit 27, whereas the fuel overflow passage 16 is circumferentially out of alignment with the second longitudinal slit 28 and blocked by the peripheral surface of the plunger 18, that is, it is isolated from the plunger chamber 2*a*. On this occasion, as the plunger 18 is moving through its lifting stroke, fuel is drawn through the fuel intake connector 12, the fuel intake passage, and the first slit 27 into the plunger chamber 2*a*. Then, when the fuel intake passage 13 is blocked by the peripheral surface of the plunger 18 during the descending stroke, the fuel within the chamber 2*a* is pressurized, and when the pressurized fuel reaches the valve opening pressure, fuel is injected through the injection nozzles. As noted above, while the plunger 18 is in this starting position, the fuel overflow passage 16 is always kept out of communication with the plunger chamber 2*a* so that all the fuel drawn into the plunger chamber 2*a* is injected through the injection holes, without being drained through the solenoid valve 17, during the descending or pressuring stroke of the plunger 18, thereby positively obtaining an increased injection quantity at the start of the engine, irrespective of the operation of the solenoid valve 17.

In the event of a failure in the electronic control device 40, the solenoid valve 17, etc. wherein the fuel injection control cannot be performed, the control rack 21 can be manually operated to bring the plunger 18 into the emergency stopping position as shown in FIG. 2 (C), which is reached by rotating the plunger counterclockwise by nearly 45 degrees from the normal operating position. In this emergency stopping position, each of the first and second longitudinal slits 27, 28 and the suction slit 29 is circumferentially out of alignment with respective one of the fuel intake passage 13 and the fuel overflow passage 16, the latter being both blocked by the peripheral surface of the plunger 18. Thus, the plunger chamber 2*a* is disconnected from both of the passages 13 and 16 whereby no supply of fuel into the chamber 2*a* takes place even with lifting of the plunger 18, to stop the fuel injection and accordingly stop the engine.

Figure 3:
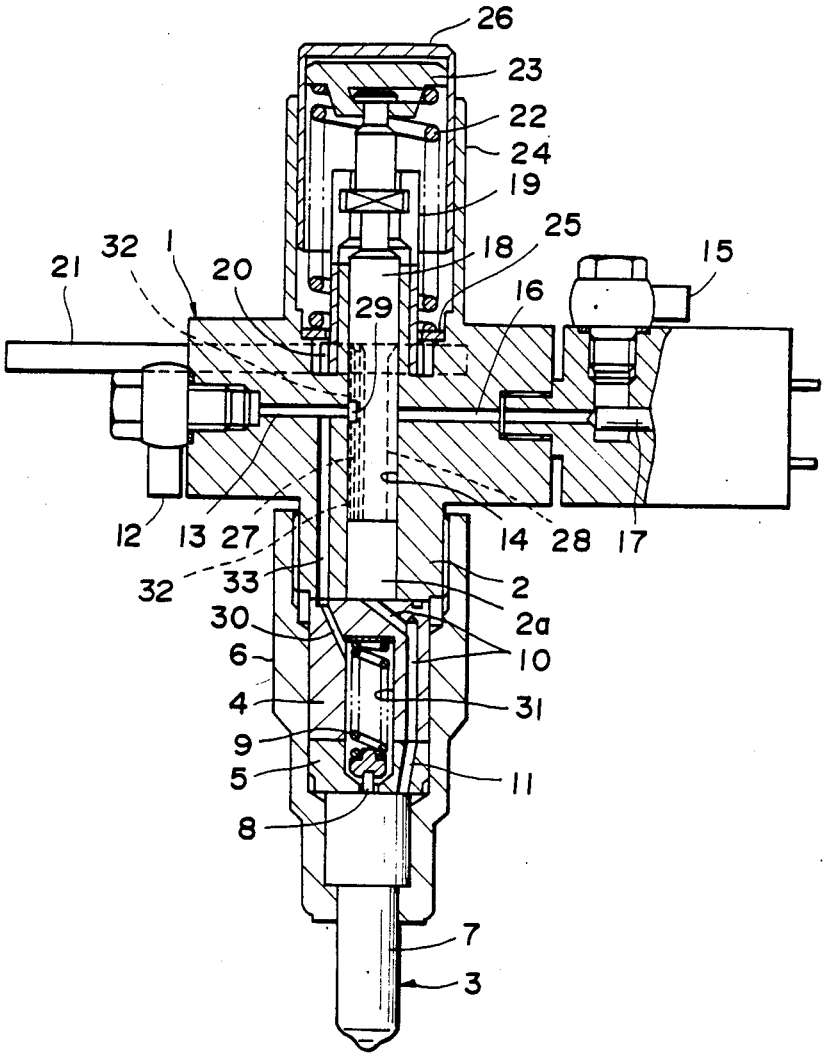
FIG. 3 is a longitudinal sectional view of a unit injector according to a second embodiment of the invention.

FIG. 3 illustrates a second embodiment of the unit injector according to the invention. In FIG. 3, corresponding elements and parts to those in FIG. 1 are designated by identical reference characters. This embodiment is distinguished from the embodiment of FIGS. 1 and 2 in that a pumping plunger 18 of the present embodiment is adapted to assume four positions, i.e. a first normal operating position with a higher injection rate, a second normal operating position with a lower injection rate, a starting position, and an emergency stopping position, as shown in FIGS. 5(A)–(D), and (A1)–(D1). More specifically, a first longitudinal slit 27 and a second longitudinal slit 28 formed in the outer peripheral surface of the pumping plunger 18 have the same length. These first and second longitudinal slits 27, 28 are circumferentially located apart from each other by an obtuse angle other than 180 degrees. The first and second longitudinal slits 27, 28 have their lower ends opening in lower end faces of the pumping plunger 18, and upper ends terminating in an axially intermediate portion of the outer peripheral surface of the plunger at the same level. That is, when the plunger 18 is in its upper extreme position, the upper ends of the first and second longitudinal slits 27, 28 are positioned at the same level above a fuel intake passage 13 and a fuel overflow passage 16, i.e. almost at the same level with a pinion 20.

Figure 4:
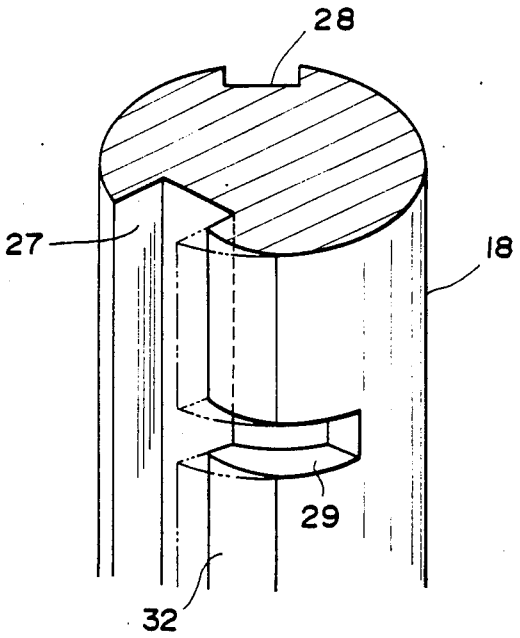
FIG. 4 is a perspective view, on an enlarged scale, of an essential part of the unit injector of FIG. 3.
Figure 5:
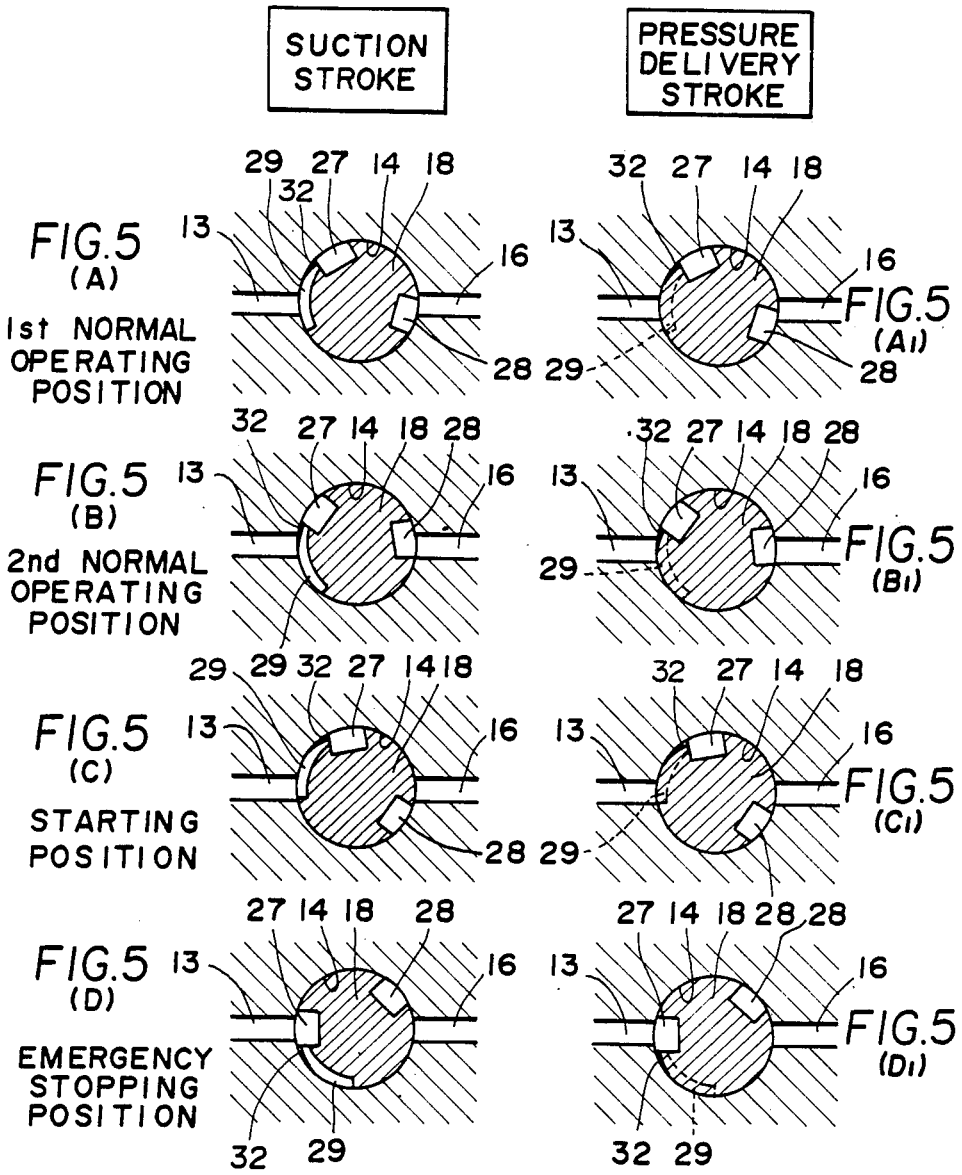
FIGS. 5(A)-(D) and (A1)-(D1) are transverse cross-sectional views of essential parts of the unit injector of FIG. 3, useful in explaining its operation.

A suction slit 29 formed in an axially intermediate portion of the outer peripheral surface of the plunger 18 and extending circumferentially of the plunger is continuous at one end with the first longitudinal slit 27 as shown in FIG. 4. The suction slit 29 is so disposed as to be circumferentially aligned with the fuel intake passage 13 as shown in FIGS. 5 (A), (B), and (C), respectively, as the plunger 18 is brought into the first normal operating position, the second normal operating position, and the starting position, so that the suction slit 29 is communicated with the fuel intake passage 13 when the plunger 18 is in its upper extreme position as illustrated in FIG. 3, thereby communicating the fuel intake passage 13 with the first longitudinal slit 27.

The plunger 18 has its outer peripheral surface formed further with a leakage groove 32 for reducing the injection rate, along a side edge of the first longitudinal slit 27 in a manner continuous therewith as shown in FIG. 4. The leakage groove 32 axially extends from a lower end edge of the suction slit 29 and opens in the lower end of the plunger 18. Its upper end terminates in an axially intermediate portion of the outer peripheral surface of the plunger 18 at the same level with the upper end of the first longitudinal slit 27, as shown by a broken line in FIG. 3. The depth of the leakage groove 32 circumferentially varies such that it becomes smaller toward an opposite side edge thereof remote from the slit 27. The leakage groove 32 is so circumferentially located as to be circumferentially aligned with the fuel intake passage 13 when the plunger 18 assumes the second normal operating position with a lower injection rate as shown in FIG. 5 (Bl), so that as the plunger 18 moves through its whole pressure delivery stroke, the leakage groove 32 continually communicates the fuel intake passage 13 with the first longitudinal slit 27.

The other component elements not referred to above are substantially identical in construction and arrangement with those in FIGS. 1 and 2, and therefore description of them is omitted.

The operation of the second embodiment is as follows:

When the engine is operating in a high speed normal operative condition requiring a high injection rate, the electronic control device 40 as appearing in FIG. 1 drives the control rack 21 to bring the plunger 18 into the first normal operating position with a higher injection rate shown in FIGS. 5 (A) and (A1). In this position, the fuel intake passage 13 is communicated with the plunger chamber 2*a* via the suction slit 29 and the first longitudinal slit 27, and the fuel overflow passage 16 with the chamber 2*a* via the second longitudinal slit 28, respectively, while the plunger 18 is in its upper extreme position.

On this occasion, as the rotating cam is rotated by the engine to cause reciprocating motion of the spring seat 23 acting as a tappet, through the cover 26, the pumping plunger 18 is forced to make reciprocating motion within the plunger bore 14, with the aid of the plunger spring 22. During the lifting or suction stroke of the plunger 18 in the position of FIG. 5 (A), fuel is drawn through the fuel intake connector 12, the fuel intake passage 13 and the first longitudinal slit 27 into the plunger chamber 2*a*. Then, as the the plunger 18 is moving through its descending or pressure delivery stroke in the position of FIG. 5 (A1), the fuel intake passage 13 is blocked by the peripheral surface of the plunger 18. When the fuel overflow passage 16 is then closed by the solenoid valve 17, the fuel drawn into the plunger chamber 2*a* starts to be pressurized into a higher pressure and then delivered into the pressure chamber within the nozzle body 7, through the passages 10, 11. When the fuel pressure within the pressure chamber 2*a* rises to overcome the force of the nozzle spring 9 (that is, when it reaches the valve opening pressure), the nozzle needle 8 is lifted to open the injection nozzles to inject fuel into the engine cylinder with a higher injection rate.

When the engine is operating in a low speed normal operative condition requiring a small injection rate, the electronic control device 40 drives the control rack 21 to bring the plunger 18 into the second normal operating position with a lower injection rate shown in FIGS. 5 (B) and (Bl), by rotating the plunger 18 counterclockwise by nearly 25 degrees from the first normal operating position. In this position, the fuel intake passage 13 is communicated with the plunger chamber 2*a* via the suction slit 29 and the first longitudinal slit, and the fuel overflow passage 16 with the chamber 2*a* via the second longitudinal slit 28, while the plunger is in its upper extreme position, in the same manner as in the first operating position.

Then, as in the same manner as in the first normal operating position, fuel is drawn through the fuel intake connector 12, the fuel intake passage 13, the suction slit 29, and the first longitudinal slit 27 into the plunger chamber 2*a*, during the lifting or suction stroke of the plunger 18 in the position of FIG. 5 (B). However, during the subsequent descending or pressure delivery stroke of the plunger in the position of FIG. 5 (Bl), the fuel intake passage 13 is communicated with the first longitudinal slit 27 via the leakage groove 32, so that when the fuel overflow passage 16 is blocked by the solenoid valve 17 to start pressurization of the fuel within the plunger chamber 2*a*, part of the pressurized fuel leaks through the first longitudinal slit 27 and the leakage groove 32 to the fuel intake passage 13. As a result, the fuel pressure within the plunger chamber 2*a* is maintained at a lower level than when the plunger 18 assumes the first normal operating position, whereby fuel injection is effected with a lower injection rate. Further, by finely varying the circumferential position of the plunger so that a different circumferential portion of the leakage groove 32 encounters the fuel intake passage 13, the leakage amount can be varied to finely adjust the injection rate to a desired value, due to the circumferentially varying depth of the leakage groove 32.

On the other hand, to start the engine, the plunger 18 is controlled to the starting position shown in FIGS. 5 (C) and (Cl) which is reached by rotating the plunger clockwise by nearly 20 degrees from the first normal operating position. Since this position is substantially identical with the starting position shown in FIG. 2 (B) of the first embodiment, fuel injection takes place with an increased injection quantity in the same manner as in the first embodiment, hereinbefore described.

In the event of a failure in the electronic control device 40, the solenoid valve 17, etc. wherein the fuel injection control cannot be performed, the control rack 21 can be manually operated to bring the plunger 18 into the emergency stopping position as shown in FIGS. 5 (D) and (D1), by rotating the plunger counterclockwise by nearly 30 degrees from the first normal operating position. In this emergency stopping position, the first intake slit 27 is circumferentially aligned with the fuel intake passage 13, while the second longitudinal slit 28 is circumferentially out of alignment with the fuel overflow passage 16 so that the passage 16 is blocked by the peripheral surface of the plunger 18 and thus isolated from the plunger chamber 2*a*.

With the plunger 18 in this position, when fuel is drawn through the intake connector 12, the fuel intake passage 13 and the first longitudinal slit 27 into the plunger chamber 2*a* during the lifting or suction stroke of the plunger, the fuel within the chamber 2*a* leaks to the fuel intake passage 13 through the first longitudinal slit 27. As a result, the fuel pressure within the plunger chamber 2*a* does not reach the valve opening pressure, whereby no fuel injection takes place, to thereby immediately stop the engine.

While preferred embodiments of the invention have been described, variations thereto will occur to those skilled in the art within the scope of the present inventive concepts which are delineated by the following claims.

What is claimed is:

1. In a unit fuel injector for an internal combustion engine, including:

a plunger barrel unit which has a plunger barrel, a pumping plunger slidably received within said plunger barrel for reciprocating motion therein and controllable in circumferential position, said plunger having one end face and an outer peripheral surface, a fuel intake passage and a fuel overflow passage both opening into said plunger barrel and blockable by the outer peripheral surface of said plunger, a plunger chamber definable within said plunger barrel and by said one end face of said plunger, and communication passage means formed in the outer peripheral surface of said plunger for communicating said plunger chamber with said fuel intake passage and said fuel overflow passage; and an injection nozzle unit combined in one body with said plunger barrel unit;

the improvement wherein:

a solenoid valve is arranged across said fuel overflow passage for closing same to determine the injection timing and the injection quantity;

said communication passage means comprises a first longitudinal slit for communicating said fuel intake passage with said plunger chamber, a second longitudinal slit for communicating said fuel overflow passage with said plunger chamber, and a circumferentially extending suction slit communicating with said first longitudinal slit and registrable with said fuel intake passage when said plunger is in an extreme position remote from said plunger chamber;

said second longitudinal slit axially extending beyond said fuel overflow passage toward an opposite end of said plunger remote from said plunger chamber so as to maintain comminucation of said fuel overflow passage with said plunger chamber throughout substantially the whole stroke of said plunger when said second longitudinal slit is circumferentially aligned with said fuel overflow passage;

said fuel intake passage, said fuel overflow passage, said first and second longitudinal slits, and said suction slit being so disposed that said plunger can assume selectively a normal operating position and a starting position, at respective first and second circumferential positions thereof;

wherein in said normal operating position of said plunger, one of said first longitudinal slit and said suction slit is circumferentially aligned with said fuel intake passage to communicate same with said plunger chamber, and said second longitudinal slit is circumferentially aligned with said overflow passage to communicate same with said plunger chamber whereby said fuel overflow passage is maintained in communication with said plunger chamber throughout substantially the whole stroke of said plunger; and in said starting position of said plunger one of said first longitudinal slit and said suction slit is circumferentially aligned with said fuel intake passage, but said second longitudinal slit is circumferentially out of alignment with said fuel overflow passage to maintain said fuel overflow passage disconnected from said plunger chamber.

2. A unit injector as claimed in claim 1, wherein said fuel intake passage, said fuel overflow passage, said first and second longitudinal slits, and said suction slit are so disposed that said plunger can further assume an emergency stopping position at a third circumferential position thereof, wherein both of said first longitudinal slit and said suction slit are circumferentially out of alignment with said fuel intake passage, and said second longitudinal slit is circumferentially out of alignment with said fuel overflow passage to be disconnected from said plunger chamber.

3. A unit injector as claimed in claim 1, wherein said first longitudinal slit extends along an axial portion of said plunger beyond said suction slit toward said opposite end of said plunger remote from said plunger chamber to such an extent that said first longitudinal slit continually communicates said plunger chamber with said fuel intake passage while said plunger is moving through a pressure delivery stroke thereof, said fuel intake passage, said fuel overflow passage, said first and second longitudinal slits, and said suction slit being so disposed that said plunger can further assume an emergency stopping position at a third circumferential position thereof, wherein said first longitudial slit is circumferentially aligned with said fuel intake passage to continually communicate said plunger chamber with said fuel intake passage while said plunger is moving through the pressure delivery stroke.

4. A unit injector as claimed in claim 1, wherein the outer peripheral surface of said plunger is further formed with a leakage groove axially extending from said suction slit at least toward said opposite end of said plunger remote from said plunger chamber and continuous with a side edge of said first longitudinal slit, said normal operating position of said plunger comprising a first normal operating position in which said leakage groove is circumferentially out of alignment with said fule intake passage to be continually blocked by the outer peripheral surface of said plunger while said plunger is moving through a pressure delivery stroke thereof, and a second normal operating position in which said leakage groove is circumferentially aligned with said intake fuel passage to be continually communicated therewith while said plunger is moving through the pressure delivery stroke to allow leakage of fuel from said plunger chamber to said fuel intake passage through said first longitudinal slit and said leakage groove to thereby reduce the injection rate.

5. A unit injector as claimed in claim 4, wherein said leakage groove has a depth varying circumferentially of said plunger, whereby the injection rate can be controlled to a desired value by varying the circumferential position of said plunger.

6. In a unit fuel injector for an internal combustion engine, including:

an injection nozzle;

a plunger barrel combined in one body with said injection nozzle;

a pumping plunger slidably received within said plunger barrel for reciprocating motion therein and controllable in circumferential position, said plunger having an end face and an outer peripheral surface;

a fuel intake passage opening into said plunger barrel and blockable by the outer peripheral surface of said plunger;

a fuel overflow passage opening into said plunger barrel and blockable by the outer peripheral surface of said plunger;

a plunger chamber definable within saidplunger barrel and said end face of said plunger;

communication passage means formed in the outer peripheral surface of said plunger for communicating said plunger chamber with said fuel intake passage and said fuel overflow passage; and a solenoid valve arranged across said fuel overflow passage for closing same to determine the injection timing and the injection quantity;

the improvement wherein:

said communication passage means comprises first and second longitudinal slits both communicating with said plunger chamber; and a circumferentially extending suction slit communicating with said first longitudinally slit and registrable with said fuel intake passage when said plunger is in an extreme position remote from said plunger chamber;

said fuel intake passage, said fuel overflow passage, said first and second longitudinal slits, and said suction slit being so disposed that said plunger can assume selectively a normal operating position and a starting position, at respective first and second circumferential positions thereof;

wherein in said normal operating position of said plunger, one of said first longitudinal slit and said suction slit is circumferentially aligned with said fuel intake passage to communicate same with said plunger chamber, and said second longitudinal slit is circumferentially aligned with said second longitudinal slit to communicate same with said plunger chamber; and wherein in said starting position of said plunger one of said first longitudinal slit and said suction slit is circumferentially aligned with said plunger chamber, but said second longitudinal slit is circumferentially out of alignment with said fuel overflow passage to maintain said fuel overflow passage disconnected from said plunger chamber; and said fuel intake passage, said fuel overflow passage, said first and second longitudinal slits, and said suction slit being so disposed that said plunger can further assume an emergency stopping position at a third circumferential position thereof, wherein both of said first longitudinal slit and said suction slit are circumferentially out of alignment with said fuel intake passage, and said second longitudinal slit is circumferentially out of alignment with said fuel overflow passage so as to be disconnected from said plunger chamber.

7. A unit injector as claimed in claim 6, wherein said first longitudinal slit extends along an axial portion of said plunger beyond said suction slit toward an opposite end of said plunger remote from said plunger chamber to such an extent that said first longitudinal slit continually communicates said plunger chamber with said fuel intake passage while said plunger is moving through a pressure delivery stroke thereof, said fuel intake passage, said fuel overflow passage, said first and second longitudinal slits, and said suction slit being so disposed that said plunger can further assume an emergency stopping position at a third circumferential position thereof, wherein said first longitudinal slit is circumferentially aligned with said fuel intake passage to continually communicate said plunger chamber with said fuel intake passage while said plunger is moving through the pressure delivery stroke.

8. A unit injector as claimed in claim 6, wherein the outer peripheral surface of said plunger is further formed with a leakage groove axially extending from said suction slit at least toward an opposite end of said plunger remote from said plunger chamber and continuous with a side edge of said first longitudinal slit, said normal operating position of said plunger comprising a first normal operating position in which said leakage groove is circumferentially out of alignment with said fuel intake passage to be continually blocked by the outer peripheral surface of said plunger while said plunger is moving through a pressure delivery stroke thereof, and a second normal operating position in which said leakage groove is circumferentially aligned with said intake fuel passage to be continually communicated therewith while said plunger is moving through the pressure delivery stroke to allow leakage of fuel from said plunger chamber to said fuel intake passage through said first longitudinal slit and said leakage groove to thereby reduce the injection rate.

9. A unit injector as claimed in claim 8, wherein said leakage groove has a depth varying circumferentially of said plunger, whereby the injection rate can be controlled to a desired value by varying the circumferential position of said plunger.

* * * * *